US010647931B2

(12) United States Patent
Pucci et al.

(10) Patent No.: US 10,647,931 B2
(45) Date of Patent: May 12, 2020

(54) PROCESS FOR THE OLIGOMERIZATION OF LIGHT OLEFINS BY MEANS OF A REACTION SECTION COMPRISING AT LEAST TWO REACTORS WHICH CAN BE PERMUTATED, PROMOTING THE SELECTIVITY FOR DISTILLATES

(71) Applicant: AXENS, Rueil Malmaison (FR)

(72) Inventors: Annick Pucci, Croissy sur Seine (FR); Marielle Gagniere, Bougival (FR)

(73) Assignee: AXENS, Rueil Malmaison (FR)

( * ) Notice: Subject to any disclaimer, the term of this patent is extended or adjusted under 35 U.S.C. 154(b) by 233 days.

(21) Appl. No.: 15/363,676

(22) Filed: Nov. 29, 2016

(65) Prior Publication Data

US 2017/0152448 A1 Jun. 1, 2017

(30) Foreign Application Priority Data

Nov. 30, 2015 (FR) ..... 15 61559

(51) Int. Cl.
*C10G 50/00* (2006.01)
*C10G 69/12* (2006.01)

(52) U.S. Cl.
CPC ..... *C10G 50/00* (2013.01); *C10G 69/126* (2013.01); *C10G 2300/1088* (2013.01); *C10G 2300/1092* (2013.01)

(58) Field of Classification Search
CPC combination set(s) only.
See application file for complete search history.

(56) References Cited

U.S. PATENT DOCUMENTS 4,482,772 A 11/1984 Tabak
4,487,985 A 12/1984 Tabak
4,547,602 A * 10/1985 Tabak ..... C07C 1/20 585/254
2015/0166424 A1* 6/2015 Vanden Bussche ... C10G 50/00 585/300

FOREIGN PATENT DOCUMENTS

EP 0136026 A2 4/1985

* cited by examiner

*Primary Examiner* — Ali Z Fadhel
(74) *Attorney, Agent, or Firm* — Millen White Zelano & Branigan, PC

(57) ABSTRACT

The invention concerns a process for the production of middle distillates, comprising at least one step for the catalytic oligomerization of a feed comprising olefins containing 3 to 9 carbon atoms, in which the reaction section comprises at least two reactors which are positioned in series and which can be permutated, each containing at least one oligomerization catalyst for the oligomerization reactions, said catalysts being identical or different, and in which the reactor which is the furthest downstream in the direction of movement of said feed comprising olefins contains the catalyst with a period of service which is shorter than the period of service of the catalysts present in the other reactors and is operated at an average temperature (WABTn) which is lower than the average temperature (WABTn−1) of the reactor directly preceding it, the difference between said average temperatures being at least 10° C. (WABTn−1−WABTn≥10° C.).

12 Claims, No Drawings

PROCESS FOR THE OLIGOMERIZATION OF LIGHT OLEFINS BY MEANS OF A REACTION SECTION COMPRISING AT LEAST TWO REACTORS WHICH CAN BE PERMUTATED, PROMOTING THE SELECTIVITY FOR DISTILLATES

FIELD OF THE INVENTION

The invention relates to the production of middle distillate by means of a process for the oligomerization of olefins containing 3 to 9 carbon atoms. A middle distillate in accordance with the invention corresponds to fractions with a boiling point of more than 140° C., of the kerosene and/or gas oil type.

PRIOR ART

Processes for the oligomerization of olefins operate in the presence of acidic catalysts. Usually, an increase in the yield of middle distillates from oligomerization processes is obtained by operating at a greater severity. This greater severity is generally obtained by means of an increase in the average temperature of the catalyst and/or by means of an increase in the dwell time of the feed on said catalyst by reducing the space velocity of the feed.

Conventionally, in order to maximize the conversion of olefins, a battery of fixed bed reactors is installed in series with intermediate cooling or direct cooling in order to control the exothermicity of the reaction. The first reactor which receives the fresh reactive feed polluted with sulphur-containing, nitrogen-containing or oxygen-containing compounds is that which comprises the catalyst which becomes deactivated first due to the formation of coke and to poisoning, in particular by the basic nitrogen-containing compounds. The head reactor thus becomes deactivated prematurely and changing the catalyst is necessary in order to maintain the performance, while the temperature of the downstream reactors is gradually increased in order to compensate for their gradual deactivation.

In accordance with another conventional implementation, fixed bed, adiabatic or isothermal reactors may be installed in parallel in a manner such as to treat only a portion of the flow and to operate in a staggered manner. In this configuration, in practice there is always a reactor which is short-circuited in order to regenerate the catalyst or replace it with fresh catalyst. In this latter configuration, because of the in-parallel positioning, the fresh reactive feed passes over the fresh or regenerated catalyst, running the risk of uncontrolled exothermicity and the disadvantage of promoting premature coking and cracking.

At the same time as the oligomerization reactions, the person skilled in the art will be aware that this type of catalysis employing an acidic catalyst generates isomerization, hydrogen transfer dismutation, cyclization (olefins=>paraffins+aromatics) and coke formation reactions which are promoted when the severity of the operating conditions is increased in order to enhance conversion of the olefins. In particular, the formation of light paraffins is observed, which translates into a significant reduction in the yield of distillate.

Patent application US 2014/0135543 describes a process for the oligomerization of olefins which can be used to maximize the desired product with the aid of a unique installation which can treat 2 distinct feeds independently with two different types of catalysts.

The patent FR 2 873 116 describes a process for the oligomerization of olefins using a catalyst based on silica-alumina. In that patent, a variety of configurations of the reaction section are described in order to carry out the process, in particular a functional mode comprising two oligomerization reactors in series with intermediate separation of the oligomers.

Thus, there is a genuine need for optimization of processes for the oligomerization of olefins which can maximize the yield of middle distillate.

Surprisingly, the Applicant has been able to demonstrate that using at least two reactors which can be permutated within an olefin oligomerization process means that better yields can be obtained without needing to make the operating conditions more severe, by means of adjusting the temperature of each of the reactors and in particular by imposing on each of the reactors a temperature which is at least 10° C. lower than the temperature of the preceding reactor.

SUBJECT MATTER OF THE INVENTION

The invention concerns a process for the production of middle distillates, comprising at least one step for the catalytic oligomerization of olefins containing 3 to 9 carbon atoms, in which the reaction section comprises at least two reactors which can be permutated each containing at least one oligomerization catalyst, and in which the reactor which is the furthest downstream in the direction of movement of said feed contains the catalyst with a period of service which is shorter than the period of service of the catalysts present in the other reactors and is operated at an average temperature (WABTn) which is lower than the average temperature (WABTn−1) of the reactor directly preceding it, the difference between said average temperatures being at least 10° C. (WABTn−1−WABTn≥10° C.).

Under these conditions, it has surprisingly been shown that installing the freshest catalyst in the last reactor can both obtain high conversions at low temperature as well as limit cracking of the heavy fractions boiling in the middle distillate temperature range, and thus maximize the yield of middle distillates, i.e. fractions with a boiling point of more than 140° C., of the kerosene and/or gas oil type.

Another advantage with this process is that it can be used to carry out the oligomerization of highly reactive branched olefins in the first reactor or reactors in the presence of a catalyst which has been passivated by the deposition of coke during its operation in the last reactor, thereby avoiding any risks of runaway. The exothermicity of the reaction employing the fresh or regenerated catalyst is also controlled by positioning it last, where it operates on the effluent from the reactors located upstream, and thus on an effluent which is free from the most reactive olefins. Thus, when the reactor located in the last position is re-started, the exothermicity usually observed is not as large and is more easily controlled, because the most reactive olefins present in the feed have been consumed in the head reactor.

DETAILED DESCRIPTION OF THE INVENTION

The invention concerns a process for the production of middle distillates by oligomerizing olefins containing 3 to 9 carbon atoms, preferably 4 to 6 carbon atoms, by means of a reaction section comprising at least n reactors which can be permutated, n being a whole number which is greater than or equal to 2. The process in accordance with the invention is distinguished from processes in accordance with the prior art in that said process is operated with reactors which can be permutated each comprising a catalyst with a different freshness, the last reactor containing the freshest catalyst and operating at an average temperature (WABTn) which is lower average temperature (WABTn−1) of the reactor directly preceding it, the difference between said average temperatures being at least 10° C. (WABTn−1−WABTn≥10° C.). This arrangement means that the selectivity for middle distillates can be improved.

The term "fresh catalyst" means a catalyst which has never been used or a catalyst which has not been used following regeneration. Thus, a catalyst is qualified as being fresher when its period of service in a reactor, possibly after regeneration, is shorter than the period of service of the catalysts present in the other reactors.

The term "period of service" means the period during which a catalyst is brought into contact with the feed.

The term "reactors which can be permutated" means reactors disposed in series and used in a cyclic manner by repeating, after a step a) during which the feed passes in succession through all of the oligomerization reactors, the steps b), b') and c) defined below in succession:

- a step b) during which the feed is introduced into the reactor which has not been deactivated located immediately downstream, with respect to the direction of movement of the feed, of the deactivated reactor, by short-circuiting the deactivated reactor,
- a step b'), which is simultaneous with step b), during which the catalyst of the deactivated reactor is regenerated or replaced,
- a step c) during which the feed passes through all of the obligomerization reactors, the reactor with the catalyst which has been regenerated or replaced in step b') being reconnected in a manner such as to be situated downstream of the other reactors with respect to the direction of movement of the feed.

The term "WABTn" means the average temperature in the last reactor. The average temperatures of the other reactors are classified as follows: WABTn−1 for the average temperature of the penultimate reactor; WABTn−2 for the average temperature of the reactor placed directly upstream of the penultimate reactor, and so on.

When the operation reaches stability, the temperature of the last reactor has to be adjusted in order to finalise the conversion, as long as the catalyst in the first position has not been passivated so that the average temperature of the bed or beds of catalyst in the last position does not exceed an average temperature known as WABTn (Weighted Average Bed Temperature). In accordance with the invention, the WABTn temperature is at least 10° C. lower, preferably at least 30° C. lower, than the average temperature of the bed or beds of catalyst in the first reactor.

The reactor containing the freshest catalyst is installed in the last position with respect to the direction of movement of the feed. This method means that each reactor is advanced by one place each time a catalyst is regenerated or replaced until it becomes the reactor occupying the first position. Said first reactor is then isolated in order to allow the catalyst to be replaced or regenerated, then it is re-connected into the last position. Thus, the first reactor always contains the least fresh catalyst, finishing its cycle in this position until it is passivated.

In accordance with a highly preferred variation, the process in accordance with the invention comprises two reactors, each reactor possibly containing several beds of catalyst. In this configuration, the freshest catalyst is charged into the second reactor.

More preferably, the process in accordance with the invention comprises three reactors. The first two reactors are functioning, while the third reactor is not functioning. Said third reactor is charged and used to replace the second reactor as soon as required. This disposition means that the unit can function continuously with two reactors functioning while the catalyst of the third reactor is regenerated or replaced.

Any type of oligomerization catalyst may be used in the process in accordance with the invention. Preferably, said catalysts are selected from zeolitic type catalysts, mixed amorphous oxide type catalysts, mixed crystalline oxide type catalysts and resin catalysts.

Zeolitic catalysts may be used in the oligomerization processes, and in this case, a binder may optionally be added, in particular to facilitate shaping of the zeolite. In particular, the zeolites belonging to the following classes described in the atlas of zeolitic structures (Atlas of Zeolite Framework Types, Ch. Baerlocher, L. B. McCusker, D. H. Olson, 6$^{th}$ Revised Edition 2007, ELSEVIER) may be used: AEL, AFO, ATO, BEA, BPH, EUO, FER, FAU, IMF, ITH, MEI, MEL, MFI, MOR, MSE, MTT, MTW, MWW, OFF, SFV, SVR, TON, TUN, UZM-8. More preferably, the following zeolites may, for example, be used: EU-1, ZSM-5, ZSM-11, ZSM-12, ZSM-22, ZSM-23, ZSM-35.

The catalysts used may or may not also be of the mixed amorphous oxide type. As an example, the patent EP 0 463 673 describes catalysts for the oligomerization of propylene based on amorphous silica-alumina with a silica/alumina molar ratio in the range 30/1 to 500/1, and U.S. Pat. No. 4,544,791 describes catalysts for the oligomerization of olefins containing 4 carbon atoms, based on aluminas promoted with boron or which are fluorinated, or indeed an amorphous silica-alumina having a silica content in the range 60% to 95% by weight.

The process is generally operated at a temperature in the range 40° C. to 350° C., preferably in the range 120° C. to 300° C.

The pressure is generally in the range 0.1 MPa to 15 MPa, preferably in the range 2 MPa to 10 MPa.

The hourly space velocity, also known as the HSV (flow rate of feed per volume of catalyst or volume of feed/(volume of catalyst·hour)) is generally in the range 0.05 $h^{-1}$ to 5.0 $h^{-1}$, preferably in the range 0.3 $h^{-1}$ to 3.0 $h^{-1}$. Since said HSV only represents the quantity of feed which has not passed through the reaction section, generally known as the fresh feed, the value for the HSV therefore does not take into account any possible recycling of the unconverted feed.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding French application No. 15/61.559, filed Nov. 30, 2015 are incorporated by reference herein.

EXAMPLES

Example 1 (Comparative)

Two Reactors in Series, not Capable of being Permutated

A feed obtained by fractionation of the total gasoline obtained from fluidized bed catalytic cracking and containing 56% by weight of olefins was used. Its sulphur content was 50 ppm by weight. The feed, which had the composition indicated in Table 1, determined by gas phase chromatography, was initially passed over a 13× molecular sieve in order to remove the nitrogen-containing compounds.

TABLE 1

Composition of the feed

| Characteristics of the feed | % by weight |
|---|---|
| C4 olefins | 1 |
| C5 olefins | 43 |
| C6 olefins | 12 |
| C4-C6 paraffins | 44 |
| C5 dienes | 800 ppm by weight |
| Density | 0.654 |

Initially, the two operating reactors contained fresh catalysts and were at the same WABT of 155° C. The temperatures of the two reactors were increased gradually over time to a temperature of 200° C. in order to compensate for the deactivation of the catalysts. These increases in temperatures were carried out in parallel in the two reactors by maintaining identical WABTs in order to keep the conversion constant over time.

In this configuration, the WABT temperature of the second reactor thus remained equal to the WABT of the first reactor over time.

The feed was thus involved in an oligomerization process comprising two reactors operating under the following initial operating conditions:

- reactor 1: WABT1=200° C. and HSV=1 $h^{-1}$, reactor comprising a bed of silica-alumina catalyst, 1.6 mm diameter extrudates (sold with reference IP 811 by Axens),
- reactor 2: WABT2=200° C. and HSV=1 $h^{-1}$, reactor comprising a bed of catalyst identical to that described for reactor 1.

The degree of conversion of the olefins containing 5 or 6 carbon atoms was 85%. The percentage by weight of the gasoline fraction (boiling point less than 140° C.) was 22% and the percentage by weight of middle distillate (boiling point more than 140° C.) was 78%.

Example 2 (In Accordance with the Invention)

Two Reactors in Series, Capable of being Permutated

The feed was identical to that of Example 1.

Initially, the two reactors, when operating, contained the same fresh catalyst as that of Example 1 and the WABT temperature of each of the reactors was 155° C.

Over time, the temperature of the two reactors was increased independently in order to compensate for the deactivation of the catalysts. The temperature of the reactor in the second position with respect to the direction of movement of the feed was kept lower than that of the reactor in the first position, while maintaining a constant conversion.

When the catalyst for reactor 2 was in mid-cycle, the reactor containing it was placed in the first position so that it became reactor 1; a reactor containing fresh catalyst was then placed in the second position in order to become reactor 2.

The feed was then engaged in an oligomerization process operating under the following operating conditions:

- reactor 1: WABT1=190° C.–HSV=1 $h^{-1}$, reactor comprising a bed of catalyst at mid-cycle,
- reactor 2: WABT2=155° C.–HSV=1 $h^{-1}$, reactor comprising a bed of fresh catalyst.

Thus, reactor 2 was operated at a WABT temperature of 35° C. below that of reactor 1.

The overall conversion of olefins containing 5 or 6 carbon atoms was 85%. The percentage by weight of gasoline fraction (boiling point less than 140° C.) was 15% and the percentage by weight of middle distillate (boiling point more than 140° C.) was 85%.

Example 3 (In Accordance with the Invention)

The feed was identical to that of Example 1.

This example was initially implemented under the conditions of Example 2 in a manner such as to obtain a reactor 1 comprising a catalyst close to its cycle end, and a reactor 2 comprising a partially deactivated catalyst.

The feed was then engaged in an oligomerization process operating under the following operating conditions:

- reactor 1: WABT1=250° C.–HSV=1 $h^{-1}$, reactor comprising a bed of catalyst at the end of its cycle,
- reactor 2: WABT2=185° C.–HSV=1 $h^{-1}$, reactor comprising the bed of partially deactivated catalyst.

The overall conversion of olefins containing 5 or 6 carbon atoms was 85%. The percentage by weight of gasoline fraction (boiling point less than 140° C.) was 17% and the percentage by weight of middle distillate (boiling point more than 140° C.) was 83%.

At this stage, the catalyst of reactor 1 was operated at a high temperature because it was close to the end of its cycle; reactor 2 was at the point of being permutated into position 1, but it was still operated at a temperature which was 65° C. lower compared with that of reactor 1 of the invention, and 15° C. lower compared with that of reactor 2 of Example 1 (comparative).

TABLE 2

Comparison of the results obtained in Examples 1, 2 and 3

| Selectivities | Example 1 (comparative) | Example 2 (invention) | Example 3 (invention) |
|---|---|---|---|
| % by weight of gasoline fraction (boiling point less than 140° C.) | 22 | 15 | 17 |
| % by weight of middle distillate (boiling point more than 140° C.) | 78 | 85 | 83 |
| % conversion of olefins containing 5 or 6 carbon atoms | 85 | 85 | 85 |

The process in accordance with the invention (Examples 2 and 3) can be used to maximize the selectivity of the oligomerization reaction for distillates compared with prior art processes (Example 1) by minimizing re-cracking of the heavy oligomers formed by the oligomerization reaction into gasoline.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for the production of middle distillates, comprising:

subjecting a feed comprising olefins having 3 to 9 carbon atoms to catalytic oligomerization in a reaction section having a first position reactor and a second position reactor, wherein said reactors are positioned in series and can be permutated, each of said reactors containing at least one bed of oligomerization catalyst, said catalyst in each of said reactors being identical or different, wherein the second position reactor, which is the furthest downstream in the direction of movement of said feed, contains the catalyst with a period of service which is shorter than the period of service of the catalyst in the first position reactor and the second position reactor is operated at an average temperature, WBATn, which is lower than the average temperature, WBATn−1, of the first position reactor, the difference between WBATn and WBATn−1 being at least 35° C., WABTn−1−WABTn ≥35° C., wherein in addition to said reaction section having said first position reactor and said second position reactor, a third reactor is provided in which the catalyst of said third reactor is being regenerated or replaced, wherein the reactors are used in a cyclic manner by:

a step a) wherein the feed passes in succession through the first position reactor and the second position reactor, a step b) wherein the first position reactor, which has become deactivated, is short-circuited and the feed is introduced directly into the second position reactor, which has not been deactivated located immediately downstream of the first position reactor, whereby the second position reactor now becomes the new first position reactor, and said third reactor with fresh catalyst is connected downstream of the new first position reactor, whereby said third reactor with fresh catalyst becomes the second position reactor, a step b'), which is simultaneous with step b), during which said deactivated reactor becomes said third reactor and the catalyst of the deactivated reactor is regenerated or replaced, repeating steps a), b) and b').

2. The process as claimed in claim 1, wherein each of said reactors contains one bed of catalyst.

3. The process as claimed in claim 1, wherein each of said reactors contains a plurality of beds of catalyst.

4. The process as claimed in claim 1, wherein the catalyst in each of said reactors is a zeolitic catalyst, a mixed amorphous oxide catalyst, a mixed crystalline oxide catalyst or a resin catalyst.

5. The process as claimed in claim 1, wherein the operating temperature in the reaction section is in the range 40° C. to 350° C.

6. The process as claimed in claim 1, wherein the operating pressure in the reaction section is in the range 0.1 MPa to 15 MPa.

7. The process as claimed in claim 1, wherein the hourly space velocity in the reaction section is in the range 0.05 $h^{-1}$ to 5.00 $h^{-1}$.

8. The process as claimed in claim 1, wherein the operating temperature in the reaction section is in the range 120° C. to 300° C.

9. The process as claimed in claim 1, wherein the operating pressure in the reaction section is in the range 2 MPa to 10 MPa.

10. The process as claimed in claim 1, wherein the hourly space velocity in the reaction section is in the range 0.3 $h^{-1}$ to 3.0 $h^{-1}$.

11. The process as claimed in claim 1, wherein the difference between WBATn and WBATn-1 is at least 45° C., WABTn-1 − WABTn ≥45° C.

12. A process for the production of middle distillates, comprising:

subjecting a feed comprising olefins having 3 to 9 carbon atoms to catalytic oligomerization in a reaction section having a first position reactor and a second position reactor, wherein said reactors are positioned in series and can be permutated, each of said reactors containing at least one bed of oligomerization catalyst, said catalyst in each of said reactors being identical or different, wherein the second position reactor, which is the furthest downstream in the direction of movement of said feed, contains the catalyst with a period of service which is shorter than the period of service of the catalyst in the first position reactor and the second position reactor is operated at an average temperature, WBATn, which is lower than the average temperature, WBATn−1, of the first position reactor, the difference between WBATn and WBATn−1 being at least 30° C., WABTn−1−WABTn ≥30° C., wherein in addition to said reaction section having said first position reactor and said second position reactor, a third reactor is provided in which the catalyst of said third reactor is being regenerated or replaced, wherein the reactors are used in a cyclic manner by:

a step a) wherein the feed passes in succession through the first position reactor and the second position reactor, a step b) wherein the first position reactor, which has become deactivated, is short-circuited and the feed is introduced directly into the second position reactor, which has not been deactivated, located immediately downstream of the first position reactor, whereby the second position reactor now becomes the new first position reactor, and said third reactor with fresh catalyst is connected downstream of the new first position reactor, whereby said third reactor with fresh catalyst reactor becomes the second position reactor, a step b'), which is simultaneous with step b), during which said deactivated reactor becomes said third reactor and the catalyst of the deactivated reactor is regenerated or replaced, repeating steps a), b) and b').

* * * * *